United States Patent [19]

Shen

[11] Patent Number: 4,988,319

[45] Date of Patent: Jan. 29, 1991

[54] BUBBLE BLOWER

[76] Inventor: Lin Mong Shen Sheng, No. 195, Chieng-Kou Rd., Hsintien Shih, Taipei Hsien, Taiwan

[21] Appl. No.: 421,565

[22] Filed: Oct. 11, 1989

Related U.S. Application Data

[63] Continuation-in-part of Ser. No. 364,513, Jun. 9, 1989, abandoned, which is a continuation of Ser. No. 110,676, Oct. 19, 1987, abandoned.

[51] Int. Cl.[5] ..... A63H 33/28

[52] U.S. Cl. ..... 446/19; 239/327; 446/20

[58] Field of Search ..... 446/15, 16, 17, 18, 446/19, 20, 21; 239/327, 434; 222/546; 239/340, 434.5

[56] References Cited

U.S. PATENT DOCUMENTS

| | | | |
|---|---|---|---|
| 614,744 | 11/1898 | Nettleton | 239/327 |
| 3,378,168 | 4/1968 | Hildebrandt | 222/546 |
| 3,945,381 | 3/1976 | Silver | 222/546 X |
| 4,123,005 | 10/1978 | Blunk | 239/327 |
| 4,804,346 | 2/1989 | Sheng | 446/17 |

*Primary Examiner*—Mickey Yu

*Attorney, Agent, or Firm*—Lowe, Price, LeBlanc, Becker & Shur

[57] ABSTRACT

An air bubble blower is disclosed. The blower consists of a tube having an input end for air and an output end. A first nozzle connects the output end, and the a second concentric nozzle is mounted surrounding the first nozzle. The second or other nozzle is spaced away from the inner nozzle and extends therebeyond. The outer nozzle mounts a socket which opens into the space between the nozzles and a squeezable reservoir is intended to be mounted on the socket opening thereinto. The reservoir is then squeezed to fill the space between the nozzles, the output plug opened, and when air is admitted from the input end bubbles will be blown at the opening of the outer nozzle.

1 Claim, 4 Drawing Sheets

BUBBLE BLOWER

This is a Continuation-in-Part application of Ser. No. 07/364,513, filed June 9, 1989, abandoned, which in turn is a Continuation application of Ser. No. 07/110,676, filed Oct. 19, 1987, abandoned.

BACKGROUND OF THE INVENTION

This invention relates to an air bubble blower. Air bubble blowers are toys that take advantage of the condensability of a resin to blow a liquid into a membrane which then condenses. Normally air bubbles are blown from a single tube. The output of the tube end is moistened with the resin, and then the bubble is blown. This type of device however can only blow one bubble per dip into the resin and therefore cannot blow bubbles successively without pausing after each bubble is blown to dip the output end into further resin.

SUMMARY OF THE INVENTION

This invention is an improved bubble blower which can make bubbles in series or make inner bubble within outer bubble one after another without dipping the output end into the resin after each bubble is blown. The device of this invention includes a blow tube having an input end for blowing air and an output which opens into a pair of concentric nozzles. The output end of the tube is received within an inner nozzle and a second outer nozzle is disposed spaced away from but surrounding the inner nozzle. A reservoir feeds the resin into the space between the nozzles so that when air is admitted to the tube, a bubble could be blown. In this way, bubbles can be blown successively one after another.

DETAILED DESCRIPTION OF THE INVENTION

Figure 1:
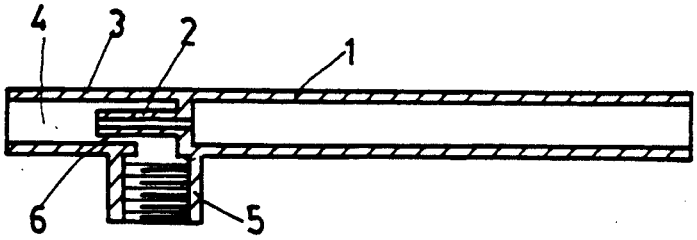
FIG. 1 is a cross-sectional view of the device of this invention.

With reference to the drawings and to FIG. 1 in particular, the device of this invention consists of a blow tube body 1, an inner nozzle 2, which connects the end of the tube body 1 and an outer concentric nozzle 3 which is spaced away from nozzle 2 and extends beyond the nozzle 2. A connecting socket 5 extends from outer nozzle 3 and opens into the interior between nozzles 2 and 3. Socket 5 is intended to receive the output end of a squeezable container 7 of resin which serves as the reservoir.

Figure 2:
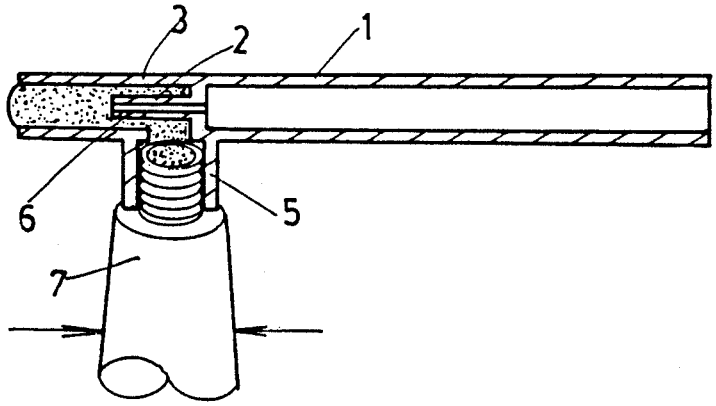
FIG. 2 is a cross-sectional view of the device of this invention squeezing the resin container.
Figure 3:
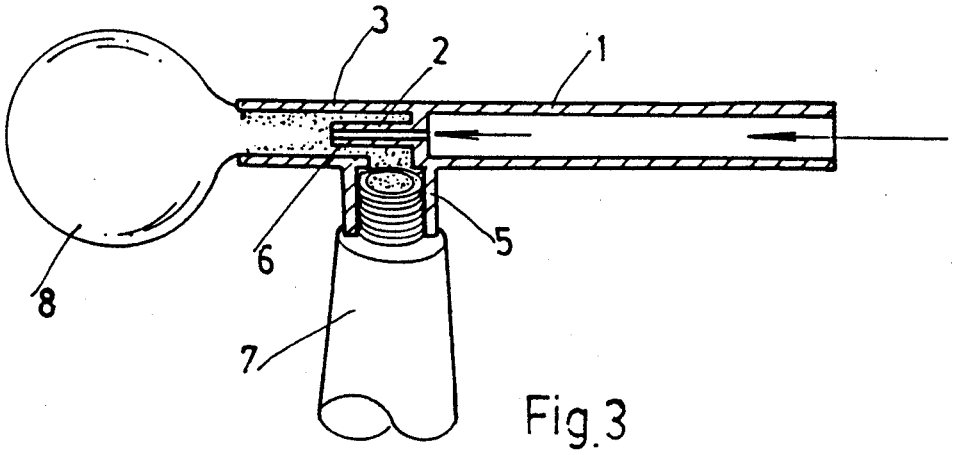
FIG. 3 is a cross-sectional view of the device of this invention blowing bubble.

With reference to FIGS. 2 and 3, to operate the device of this invention the resin container 7 which is intended to be attached to socket 5 is squeezed until the resin fills the space between nozzles 2 and 3 and the area extending beyond the output end 6 of nozzle 2. This area is designated by reference number 4. After the bubble 8 is blown, the bubble can be seperated from the nozzle by pinching with fingers.

Figure 4:
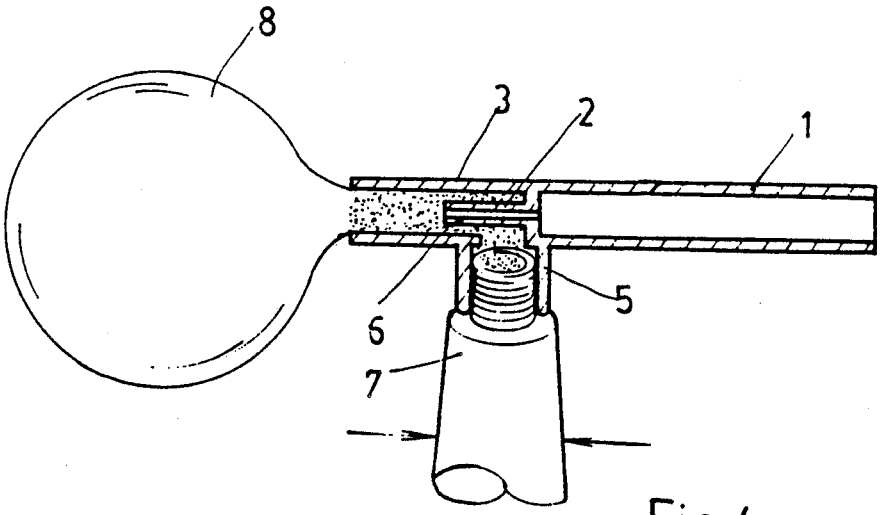
FIG. 4 is a cross-sectional view of the device of this invention squeezing the resin container again after the bubble is blown.
Figure 5:
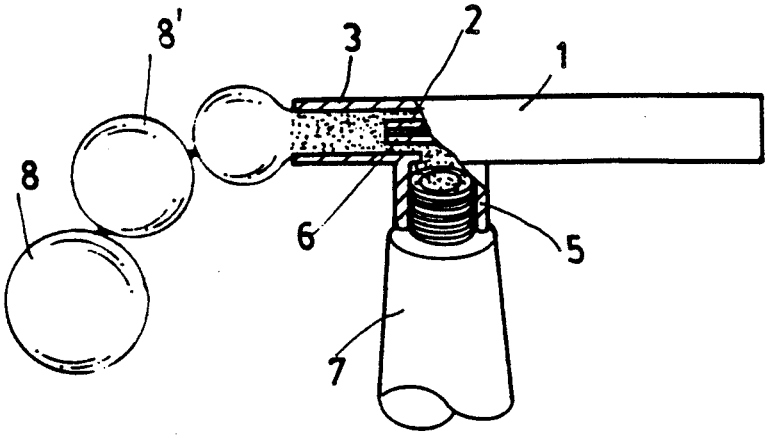
FIG. 5 is a perspective view and partial section of the device of this invention blowing a series of bubbles.

With reference to FIGS. 4 and 5, the device of this invention can make a series of bubbles by squeezing the resin container 7, blowing the bubble, squeezing the end of the bubble adjacent the nozzle and then repeating the process.

Figure 6:
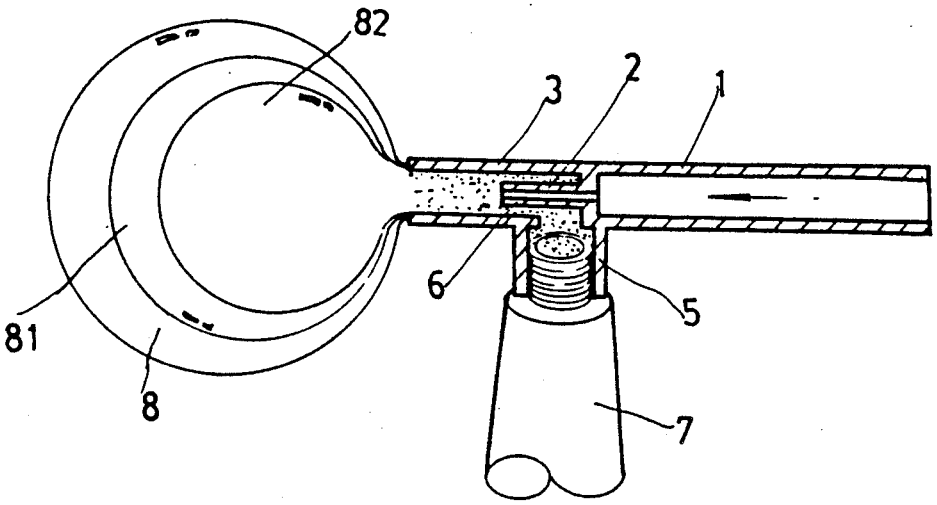
FIG. 6 is a cross-sectional view of the device of this invention blowing inner bubbles within outer bubble.

With reference to FIGS. 4 and 6, the device of this invention can make second bubble 81, within first bubble 8 by squeezing the container 7 and then blowing the second bubble 81. It can make third bubble 82 within second bubble 81 by repeating the process.

I claim:

1. An air bubble blower capable of blowing bubbles connected in series or one or more inside another consisting of:

a tube having a constant predetermined inner diameter throughout the length thereof, said tube having one end for admitting air and an opposite, output end forming a first nozzle;

a second tubular nozzle integrally disposed within the first nozzle having an input end for admitting air and an output end, the output end of said tube extending beyond the output end of said second nozzle, said second nozzle having a constant inner diameter throughout the length thereof, a predetermined length of the outer wall of said second nozzle including the output end being spaced away from the inner wall of said first nozzle; and a socket mounted on said first nozzle and opening into the space between said first and second nozzles, said socket adapted to mount a reservoir of liquid bubble blowing material.

* * * * *